US010829346B2

(12) United States Patent
Illedits et al.

(10) Patent No.: US 10,829,346 B2
(45) Date of Patent: Nov. 10, 2020

(54) MOVING WALKWAY

(71) Applicant: Otis Elevator Company, Farmington, CT (US)

(72) Inventors: Thomas Illedits, Neufeld an der Leitha (AT); Alexander Turek, Münchendorf (AT); Martin Michalke, Brunn am Gebirge (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/247,951

(22) Filed: Jan. 15, 2019

(65) Prior Publication Data

US 2019/0218070 A1 Jul. 18, 2019

(30) Foreign Application Priority Data

Jan. 15, 2018 (EP) ..... 18151576
May 9, 2018 (EP) ..... 18171528

(51) Int. Cl.

| | |
|---|---|
| ***B66B 23/08*** | (2006.01) |
| ***B66B 21/10*** | (2006.01) |
| ***B66B 23/10*** | (2006.01) |
| ***B66B 23/02*** | (2006.01) |
| ***B66B 23/14*** | (2006.01) |

(52) U.S. Cl.

CPC ..... *B66B 21/10* (2013.01); *B66B 23/024* (2013.01); *B66B 23/026* (2013.01); *B66B 23/08* (2013.01); *B66B 23/10* (2013.01); *B66B 23/145* (2013.01); *B66B 23/147* (2013.01); *B66B 23/14* (2013.01)

(58) Field of Classification Search

None

See application file for complete search history.

(56) References Cited

U.S. PATENT DOCUMENTS

| | | | | |
|---|---|---|---|---|
| 6,398,003 | B1 | 6/2002 | Jasinetzky | |
| 6,644,466 | B2 | 11/2003 | Knott et al. | |
| 8,636,134 | B2 | 1/2014 | Fargo | |
| 8,905,228 | B2 * | 12/2014 | Nagel | B65G 21/06 198/852 |

(Continued)

FOREIGN PATENT DOCUMENTS

| | | |
|---|---|---|
| DE | 1530022 A1 | 9/1969 |
| DE | 1816611 A1 | 7/1970 |

(Continued)

OTHER PUBLICATIONS

European Search Report for application EP 18171528.5, Sep. 13, 2018, 7 pages.

(Continued)

*Primary Examiner* — Kavel Singh
(74) *Attorney, Agent, or Firm* — Cantor Colburn LLP

(57) ABSTRACT

A moving walkway (1) comprises at least one endless belt (12) moving in a conveyance direction along a closed loop and a plurality of pallets (20). The closed loop comprises a conveyance portion (16) and a return portion (18) extending between two turnaround portions (5, 7), respectively. Each of the pallets (20) comprises at least one mounting portion (20*a*, 20*b*) rotatably attached to the at least one belt (12), and at least one mechanical connection (21) connecting the pallet (20) with the at least one mounting portion (20*a*) of an adjacent pallet (20).

16 Claims, 8 Drawing Sheets

(56) References Cited

U.S. PATENT DOCUMENTS

| | | | | |
|---|---|---|---|---|
| 9,394,144 | B2 | 7/2016 | Srb-Gaffron et al. | |
| 9,499,376 | B2 * | 11/2016 | Park | B66B 21/10 |
| 10,035,681 | B2 * | 7/2018 | Turek | B66B 23/026 |
| 2003/0132087 | A1 * | 7/2003 | Inoue | B66B 21/10 198/814 |
| 2012/0024675 | A1 | 2/2012 | Spielman | |
| 2017/0362060 | A1 | 12/2017 | Turek | |

FOREIGN PATENT DOCUMENTS

| | | | |
|---|---|---|---|
| DE | 20100833 | U1 | 4/2001 |
| EP | 0771756 | A2 | 5/1997 |
| EP | 0934171 | A1 | 8/1999 |
| EP | 0822918 | B1 | 12/1999 |
| EP | 0795512 | B1 | 7/2000 |
| EP | 1064210 | B1 | 1/2003 |
| EP | 1711427 | A2 | 10/2006 |
| EP | 1590290 | B1 | 4/2007 |
| EP | 2050707 | A1 | 4/2009 |
| EP | 1377408 | B1 | 5/2009 |
| EP | 1597186 | B1 | 6/2009 |
| EP | 1755999 | B1 | 9/2009 |
| EP | 1723056 | B1 | 6/2010 |
| EP | 3024771 | B1 | 5/2017 |
| EP | 3099617 | B1 | 2/2018 |
| GB | 510029 | A | 7/1939 |

OTHER PUBLICATIONS

Chinese Office Action for Application No. 2019100354672; dated May 5, 2020; 9 pages.

* cited by examiner

MOVING WALKWAY

The invention relates to a moving walkway, in particular to a belt driven moving walkway.

Moving walkways usually comprise a plurality of pallets connected to each other by at least one chain forming an endless conveyance band. The pallets move along an upper conveyance portion and a lower return portion. In turnaround portions established at the ends of the moving walkway, the pallets are transferred from the conveyance portion into the return portion and vice versa. Additional space is needed at the ends of the moving walkway for establishing the turnaround portions.

It would be beneficial to provide an improved moving walkway which needs less space without deteriorating the safety of operating the moving walkway.

A moving walkway according to an exemplary embodiment of the invention comprises at least one endless belt moving in a conveyance direction along a closed loop. The closed loop comprises a conveyance portion and a return portion extending between two turnaround portions, respectively. The moving walkway further comprises a plurality of pallets. Each of the pallets has at least one mounting portion rotatably attached to the at least one belt, and at least one mechanical connection connecting the pallet with the at least one mounting portion of an adjacent pallet.

In a moving walkway according to an exemplary embodiment of the invention, using at least one belt for driving the pallets allows reducing the space needed for establishing the turnaround portions. The pallets are connected to each other independent of the at least one belt by the mechanical connections, thus forming an endless conveyance band without the aid of the at least one belt. Thus, the conveyance band of pallets remains intact even in case of a failure of the at least one belt, e.g. in case the at least one belt should break. In consequence, a moving walkway according to an exemplary embodiment of the invention may be operated safely as no wide gaps, in which extremities (hands or legs) of passengers could be trapped, will open between adjacent pallets on the running moving walkway, even in case the at least one belt should brake.

A number of optional features are set out in the following. These features may be realized in particular embodiments, alone or in combination with any of the other features.

The at least one mechanical connection may be provided by at least one connection portion, in particular by at least one connection portion formed integrally with the pallet. Providing the at least one mechanical connection by a connection portion reduces the number of elements of the moving walkway. In consequence, the costs of manufacture and assembly may be reduced.

For attaching the pallet to the belt, the at least one mounting portion may comprise at least one linkage axle or pin rotatably mounted to the at least one belt. Each mounting portion may comprise a single linkage axle (pin) or two linkage axles (pins) extending coaxially with each other.

The at least one linkage axle or pin may extend rotatably through a hole formed within the connection portion of an adjacent pallet forming a rotatable mechanical connection between two adjacent pallets.

The at least one hole may be an elongated hole allowing the at least one linkage or pin not only to rotate within the hole, but also to slide along the longitudinal extension of the elongated hole. Forming the hole as an elongated hole adds an additional degree of freedom to the connection between two adjacent pallets.

The longitudinal extension of the elongated hole in particular may extend parallel to the at least one belt in order to allow varying the distance between two adjacent pallets in a direction parallel to the extension of the at least one belt. Such a variation of the distance allows reducing the space needed for transferring the pallets between the conveyance portion and the return portion in the turnaround portions. As a result, the diameter of the turnaround portions and in consequence the height of the moving walkway may be reduced.

Webs may be attached to the at least one belt. The linkage axles or pins of the pallets may be attached to the webs for attaching the pallets to the at least one belt.

In one configuration, the linkage axles or pins may be non-rotatably fixed to the pallets and rotatably supported by the webs for rotatably attaching the pallets to the at least one belt.

In an alternative configuration, the linkage axles or pins may be rotatably fixed to the pallets and non-rotatably supported by the webs.

In yet another configuration, the linkage axles or pins may be non-rotatably but only slidable within the elongated hole of the adjacent pallet. In said configuration, the linkage axles are rotatably fixed to the pallets and rotatably supported by the webs.

The webs may be attached to the at least one belt at positions corresponding to a portion of the at least one belt which is neither compressed nor stretched when the belt is bent in the turnaround portions. In such a configuration, the stress exerted onto the belt is reduced prolonging the lifetime of the belt.

The at least one belt may be arranged below the pallets in the conveying portion. Similarly, the at least one belt may be arranged above the pallets in the return portion. Arranging the least one belt above/below the pallets allows reducing the space needed in the lateral direction, i.e. in a direction oriented orthogonally to the conveyance direction.

The moving walkway may comprise pallet rollers attached to the pallets. The moving walkway may further comprise guide rails configured for guiding and supporting the pallet rollers in order to support the load of the pallets and of passengers standing on the pallets.

The pallet rollers may travel through the turnaround portions without being supported by any guide rails. This avoids installing curved guide rails in the turnaround portions. Curved guide rails are more complicated to produce, install and adjust for a noise and vibration less operation and low wearing than straight guide rails. Thus, the fabrication and installation of the moving walkway is simplified when no curved guide rails are needed.

In an alternative configuration, the pallet rollers may be guided through the turnaround portions by arcuate guide rails, in particular by guide rails extending along a circular arc in order to reduce the forces, in particular centrifugal forces, acting onto the belt.

Each of the pallets may be supported by at least two pallet rollers for distributing the load acting onto the pallet rollers. In such a configuration the at least one belt may be arranged between the at least two pallet rollers. This allows for easy access to the rollers and results in a high stability with respect to tilting, in particular when passengers stand on the lateral side portions of the pallets. It further enhances the directional stability of the movement of the pallets in the lateral direction.

The moving walkway may comprise at least two belts extending parallel to each other, wherein each pallet is attached to each of the belts. Employing a plurality of belts reduces the forces acting on each of the belts. It further provides redundancy so that the moving walkway may be operated at least in an emergency operation mode, e.g. with reduced speed, in case one of the belts should break.

In such a configuration the pallet rollers may be arranged between the at least two belts. The at least two pallet rollers in particular may be arranged coaxially with each other. In a configuration in which the pallet rollers are arranged coaxially between the belts, a common axle may be used for supporting at the least two pallet rollers. Further, in such a configuration, a high stiffness/rigidity may be achieved without increasing the weight of the pallets.

In the following exemplary embodiments of the invention are described with reference to the enclosed figures.

Figure 1:
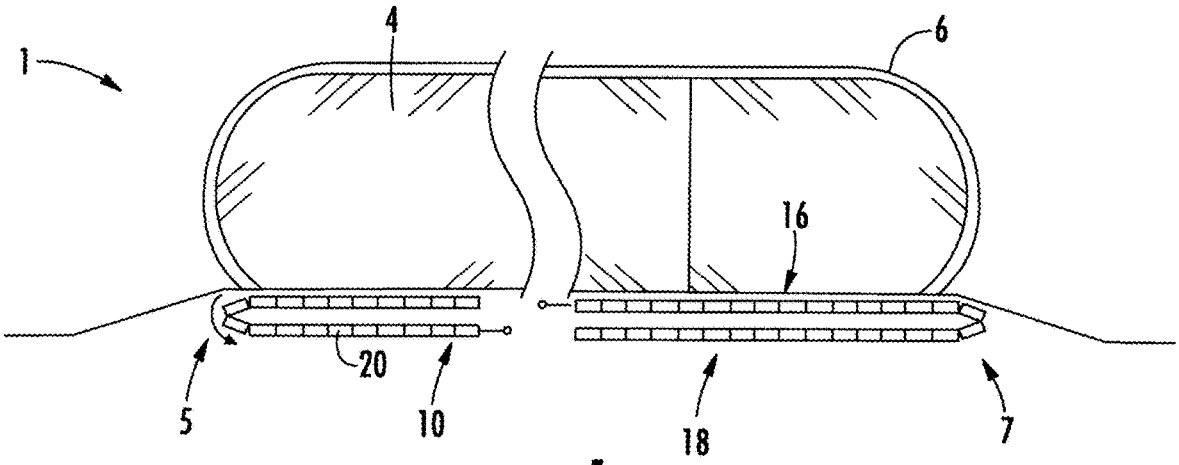
FIG. 1 depicts a schematic side view of a moving walkway according to an exemplary embodiment of the invention.

FIG. 1 schematically depicts a schematic side view of a moving walkway 1.

The moving walkway 1 comprises an endless conveyance band 10 including a plurality of conveying elements (pallets) 20 moving in a closed loop along an upper conveyance portion 16 and a lower return portion 18. First and second turnaround portions 5, 7, are provided at both ends of the moving walkway 1. In the turnaround portions 5, 7, the conveyance band 10 passes from the conveyance portion 16 into the return portion 18, and vice versa.

Optionally balustrades 4 supporting moving handrails 6 extend parallel to the conveyance portion 16.

The details of the conveyance band 10 as it is employed in a moving walkway 1 according to an exemplary embodiment of the invention are discussed in the following with reference to FIGS. 2 to 7.

Figure 2:
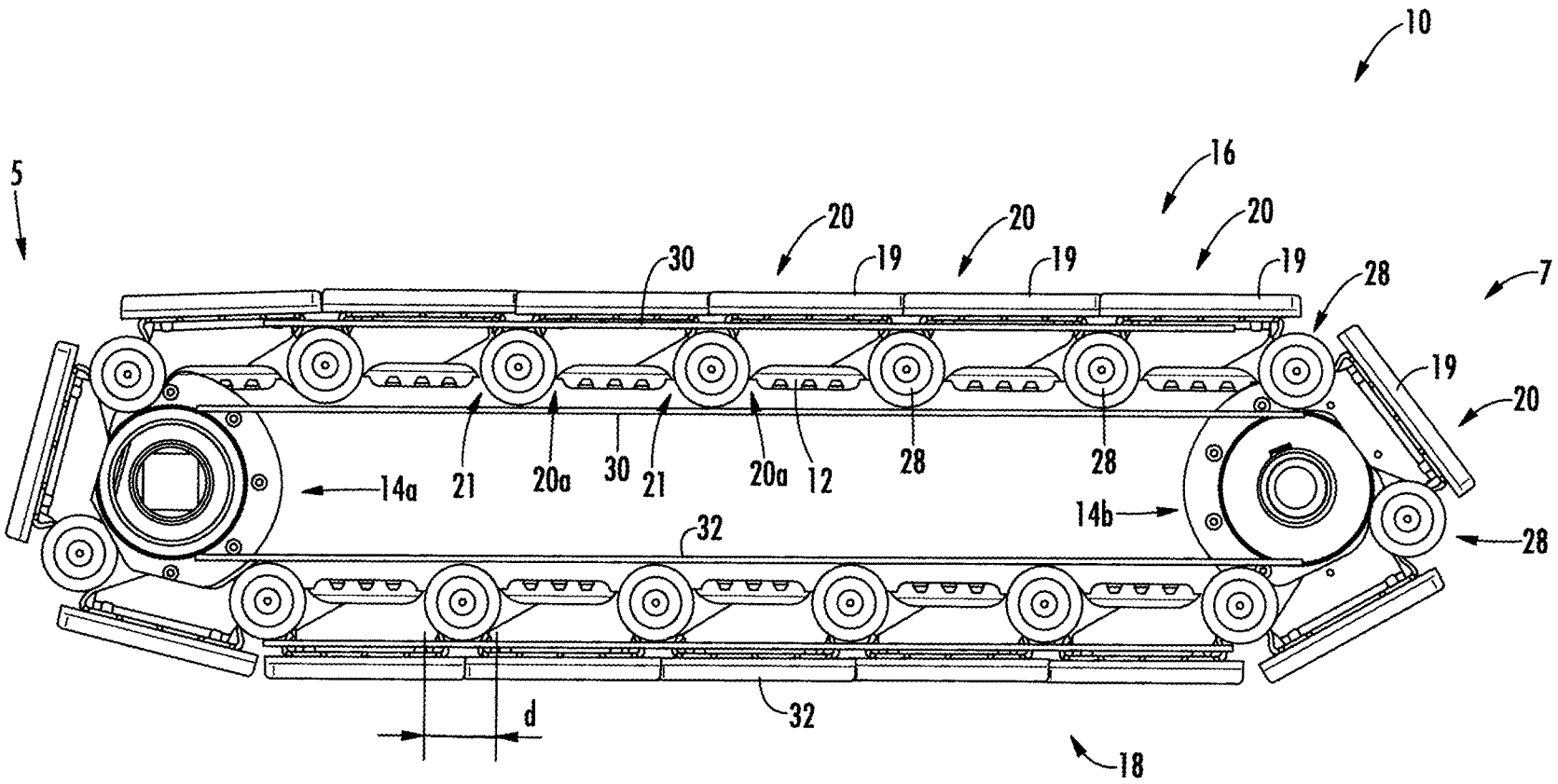
FIG. 2 depicts a side view of a conveyance band as it is employed in a moving walkway according to an exemplary embodiment of the invention.

FIG. 2 depicts a side view of the conveyance band 10 of a moving walkway 1 according to an exemplary embodiment of the invention.

Figure 3:
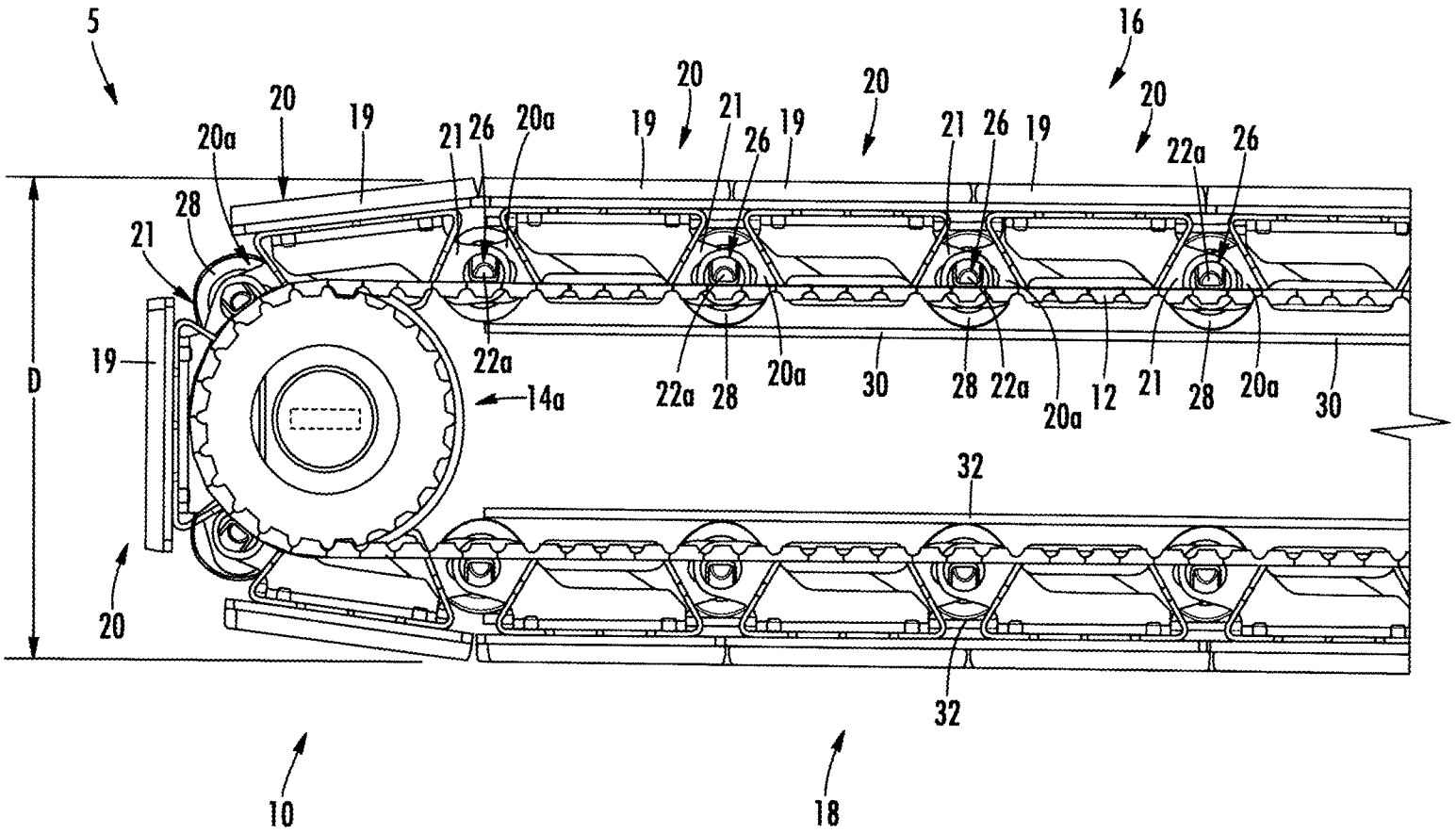
FIG. 3 depicts an enlarged sectional view of a portion of the conveyance band shown in FIG. 2 next to one of the turnaround portions.

FIG. 3 depicts an enlarged sectional view of the conveyance band 10 next to the first turnaround portion 5.

Figure 4:
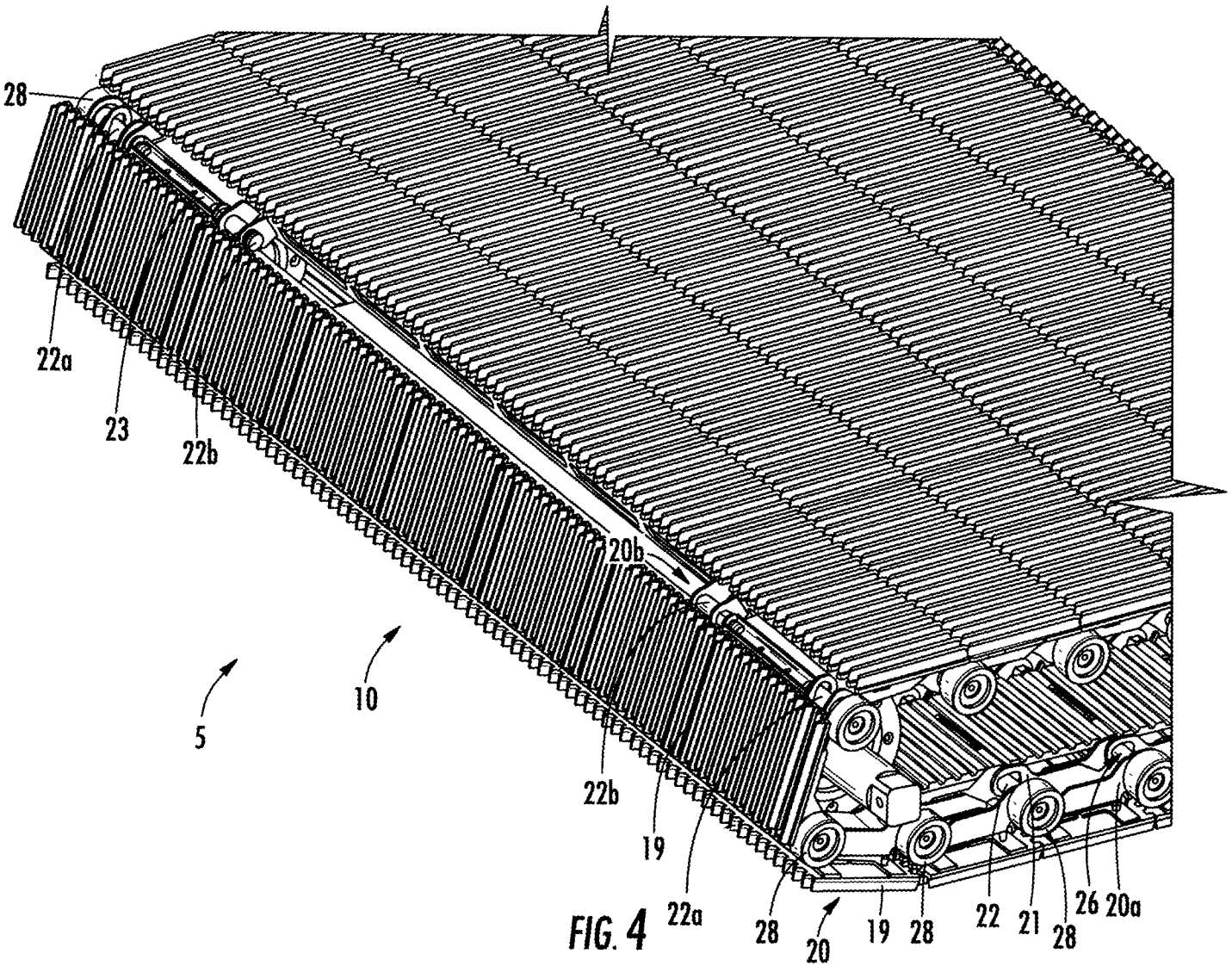
FIG. 4 depicts a perspective view of the portion of the conveyance band shown in FIG. 2 next to one of the turnaround portions.

FIG. 4 depicts a perspective view of the conveyance band 10 next to the first turnaround portion 5.

Figure 5:
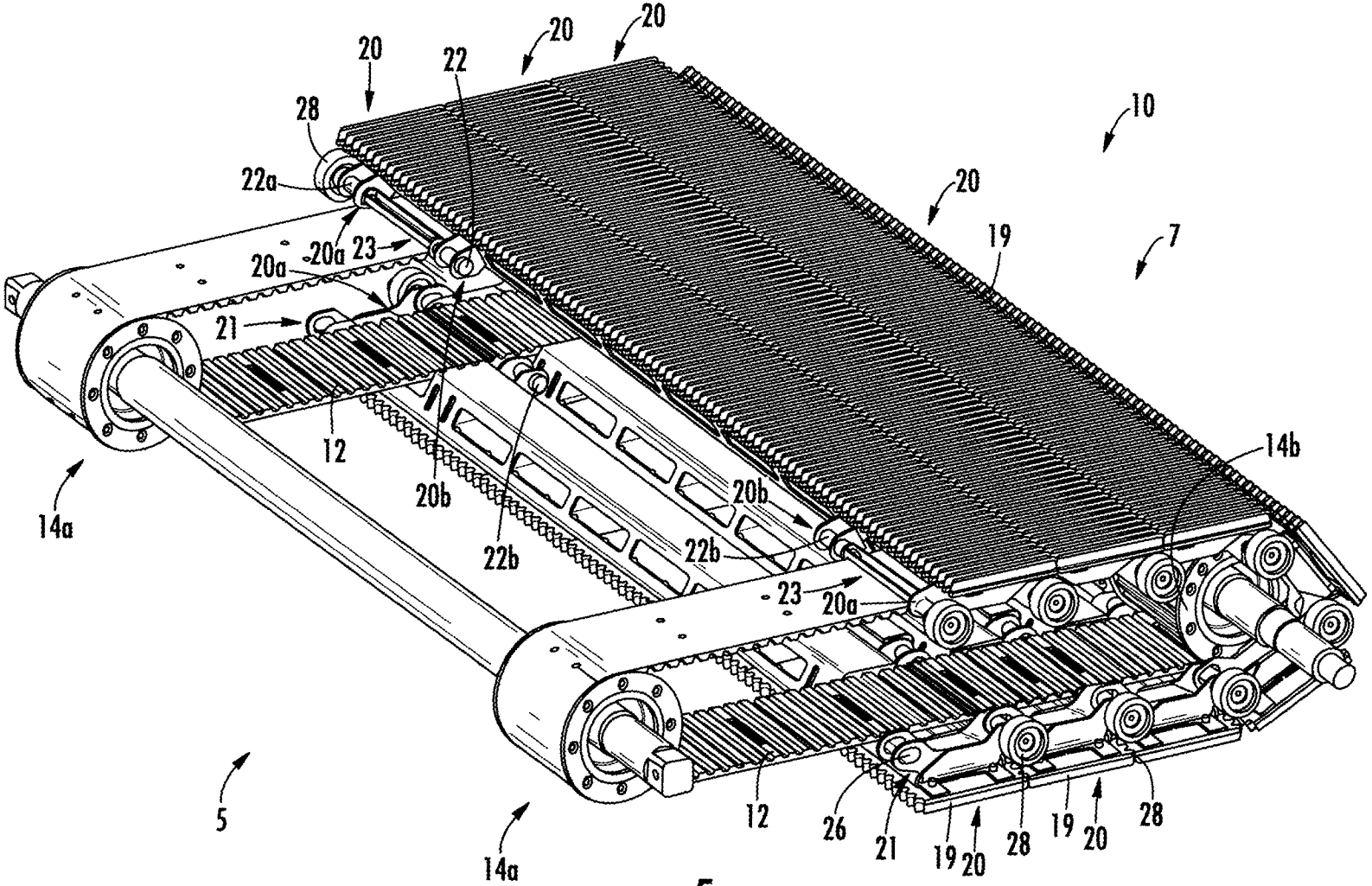
FIG. 5 depicts a perspective view of the conveyance band with some of the pallets being removed.

FIG. 5 depicts a perspective view of the conveyance band 10 next to the second turnaround portion 7 with some of the pallets 20 being removed.

Figure 6:
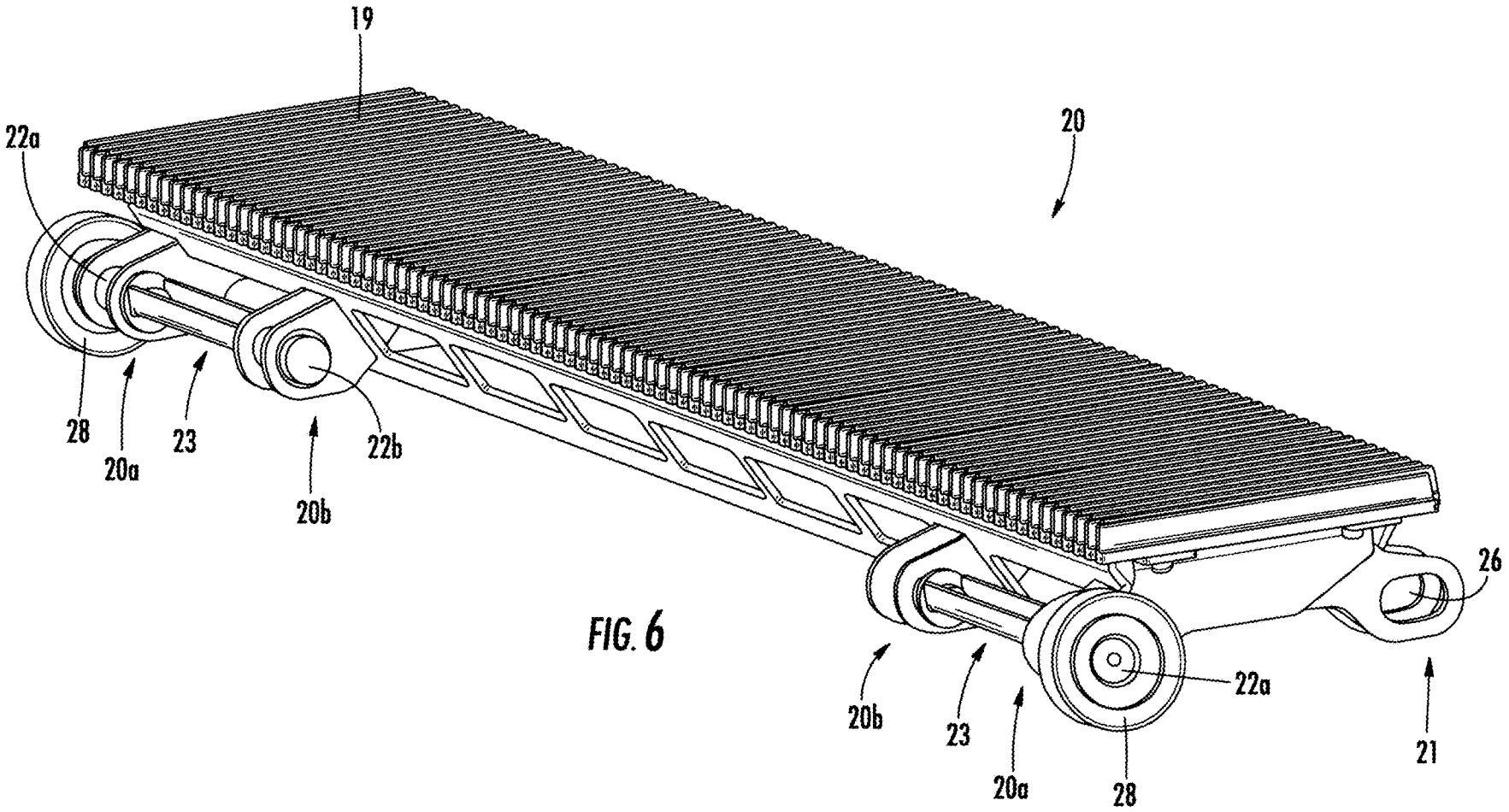
FIG. 6 shows a perspective view of a pallet according to an exemplary embodiment of the invention.

FIG. 6 shows a perspective view of a pallet 20 according to an exemplary embodiment of the invention.

Figure 7:
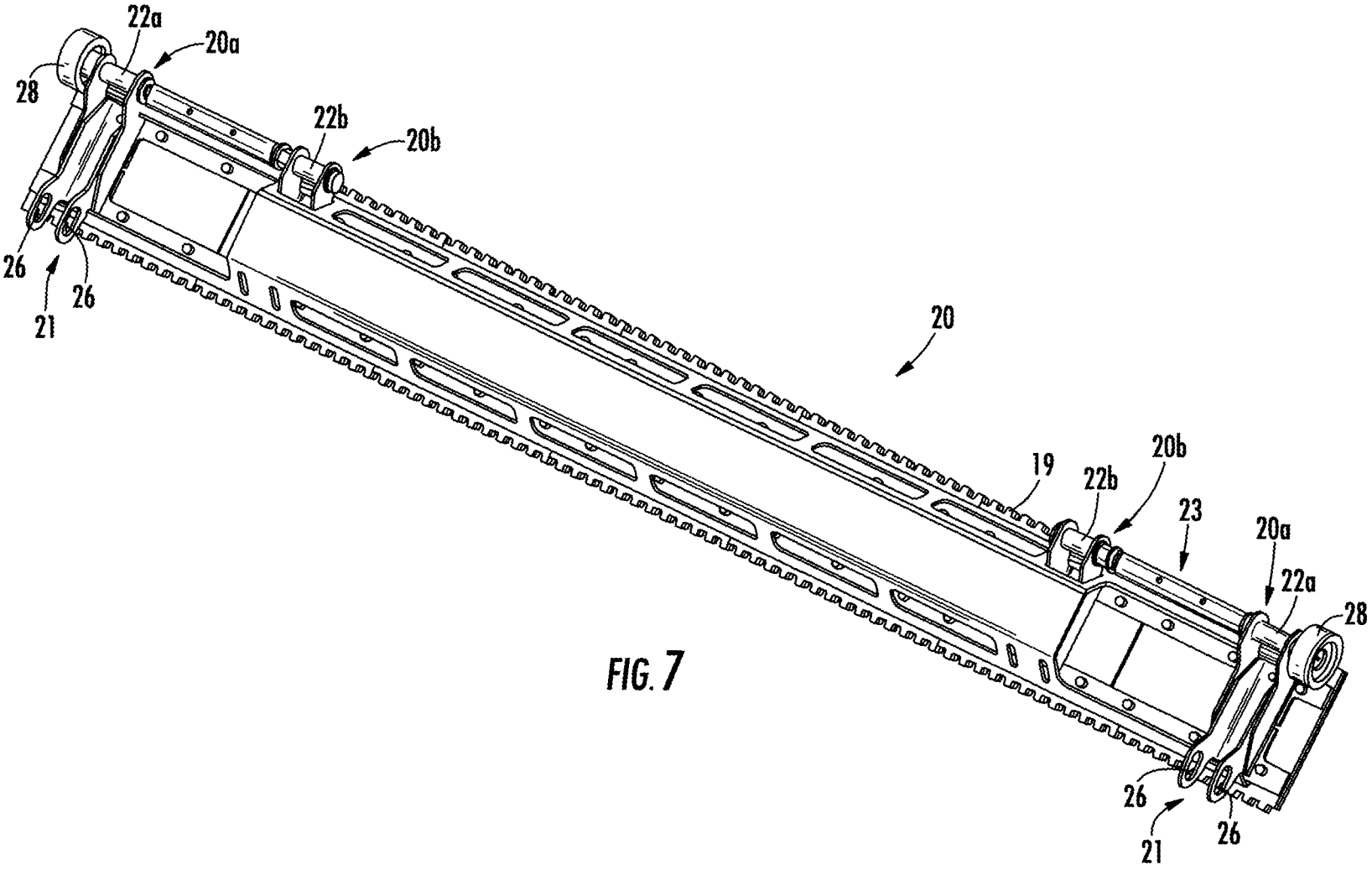
FIG. 7 shows a perspective view of the pallet from below.

FIG. 7 shows a perspective view of the pallet 20 from below.

In order to enhance the clarity of the figures, not all of the plurality of identical features are denoted with reference signs in FIGS. 2 to 5.

The conveyance band 10 depicted in FIGS. 2 to 5 comprises at least one toothed belt 12 extending in a conveyance direction along the upper conveyance portion 16 and the lower return portion 18 between two sprockets 14*a*, 14*b* arranged in the turnaround portions 5, 7 of the moving walkway 1.

The sprockets 14*a*, 14*b* are configured for transferring the belt 12 between the conveyance portion 16 and the return portion 18. The belt 12 may have a width of 100 mm to 200 mm, in particular a width of 125 mm to 175 mm, more particularly a width of 150 mm in the lateral direction.

The teeth of the belt 12 engage with the sprockets 14*a*, 14*b*. At least one of the sprockets 14*a*, 14*b* is driven by a drive mechanism (not shown) for driving the belt 12. In an alternative embodiment, a diverter wheel (not shown) may be used instead of one of the sprockets 14*a*, 14*b*.

The conveyance band 10 further comprises a plurality of pallets 20 attached to the belt 12. Each of the pallets 20 comprises a tread plate 19 for supporting passengers using the moving walkway 1.

As visible in FIGS. 4 and 5, the moving walkway 1 comprises two belts 12 extending parallel to each other. In the turnaround portions 5, 7, each of the belts 12 is in engagement with and guided by an associated sprocket 14*a*, 14*b*, respectively.

Each pallet 20 is attached to both belts 12. The attachment of the pallets 20 to the belts 12 is identical for both belts 12. Thus, in the following the attachment of the pallets 20 is described with respect to only one of the belts 12.

Each pallet 20 comprises at least one mounting portion 20*a*, 20*b* and at least one connection portion 21. The mounting portions 20*a*, 20*b* are shown on the left side of the pallet 20 depicted in FIG. 6 and on the left sides of the pallets 20 arranged in the upper conveyance portion 16 depicted in FIGS. 2 to 5. Correspondingly, the connection portions 21 are shown on the right side of the pallets 20 in these figures. The mounting portions 20*a*, 20*b* are spaced apart from the connection portions 21 along the conveyance direction.

As illustrated in FIGS. 4 to 7, each pallet 20 comprises an outer mounting portion 20*a* arranged on one side (outside) of the belt 12, and an inner mounting portion 20*b* arranged on the other side (inside) of the belt 12. Only the outer mounting portions 20*a* are visible in FIGS. 2 and 3.

Each pallet 20 further comprises a connection portion 21 arranged laterally outside of the belt 12.

In an alternative embodiment, which is not shown in the figures, the pallets 20 may comprise an additional connection portion 21 corresponding to the inner mounting portion 20*b* provided laterally inside of the belt 12.

Each of the mounting portions 20*a*, 20*b* and the connection portions 21 comprises two lugs extending parallel to each other forming a gap in between.

A plurality of webs 23 are provided on the non-toothed outer surface of the belt 12. The webs 23 may be attached to the belt 12 by an adhesive and/or by appropriate fixing elements such as bolts or screws extending into or through the belt 12. Alternatively, the webs 23 may be formed integrally with the belt 12.

Outer and inner linkage axles (or pins) 22*a*, 22*b* extending through the mounting portions 20*a*, 20*b* of the pallets 20 are rotatably supported by the webs 23 (see FIGS. 4 and 5). As a result, the mounting portions 20*a*, 20*b* of each pallet 20 are rotatably attached to the belt 12 by the linkage axles 22*a*, 22*b* in combination with the webs 23.

Elongated holes 26 are formed in the connection portions 21. The longitudinal extension of the elongated holes 26 is oriented parallel to the extension of the belt 12. The outer linkage axles 22*a* of each pallet 20 extend through the elongated holes 26 formed within the connection portion 21 of an adjacent pallet 20. Thus, the inner linkage axles 22*b* attach each pallet 20 to the belt 12, and the outer linkage axles 22*a* connect each pallet 20 with the belt 12 and with an adjacent pallet 20.

The outer linkage axles 22*a* are rotatable and slidable within the elongated holes 26 providing two degrees of freedom between two adjacent pallets 20.

According to exemplary embodiments of the invention, the pallets 20 are connected with each other independently of the belt 12 forming an endless chain of pallets 20. Thus, although all pallets 20 are individually attached to the belt 12, the belt 12 is not necessary for maintaining a secure connection between the pallets 20. In consequence, the chain of pallets 20 remains intact even in case the belt 12 should brake. This feature enhances the safety of the moving walkway 1.

Each pallet 20 further is equipped with at least one pallet roller 28 rotatably supported by an outer linkage axle 22*b*. In the embodiment depicted in FIGS. 2 to 7, a single pallet roller 28 is supported by the outer linkage axle 22*b* on each lateral side of the pallet 20. The pallet rollers 28 are guided by straight guide rails 30, 32 in the conveyance portion 16 and in the return portion 18, respectively.

The pallet rollers 28 may have a diameter d (see FIG. 2) of 25 mm to 100 mm, in particular a diameter d of 55 mm. The width of the pallet rollers 28 in the lateral direction may be in between 20 mm and 25 mm. The pallet rollers 28 in particular may have a width of 22 mm in the lateral direction.

The guide rails 30, 32 do not extend into the turnaround portions 5, 7, at least not to such an extent as to guide the pallet rollers 28 around the turnaround portions 5, 7.

Thus, in the turnaround portions 5, 7 the conveyance band 10 is guided only by the engagement of the belt 12 with the respective sprocket 14.

The moving walkway 1 illustrated in the figures in particular does not comprise any curved guide rails for guiding the pallet rollers 28 around the curved turnaround portions 5, 7. Curved guide rails are more difficult to handle than straight guide rails. Thus, not employing curved guide rails facilitates the installation of the moving walkway 1, as no curved guide rails need be manufactured, transported, installed, and aligned. Guiding the rollers 30 along curved guide rails further would generate additional noise during operation.

The additional degree of freedom provided by the elongated holes 26 allows for a small diameter D (cf. FIG. 3) of the turnaround portions 5, 7, in particular for a diameter D that is smaller than the diameter of the turnaround portions 5, 7 of conventional moving walkways.

Figure 8:
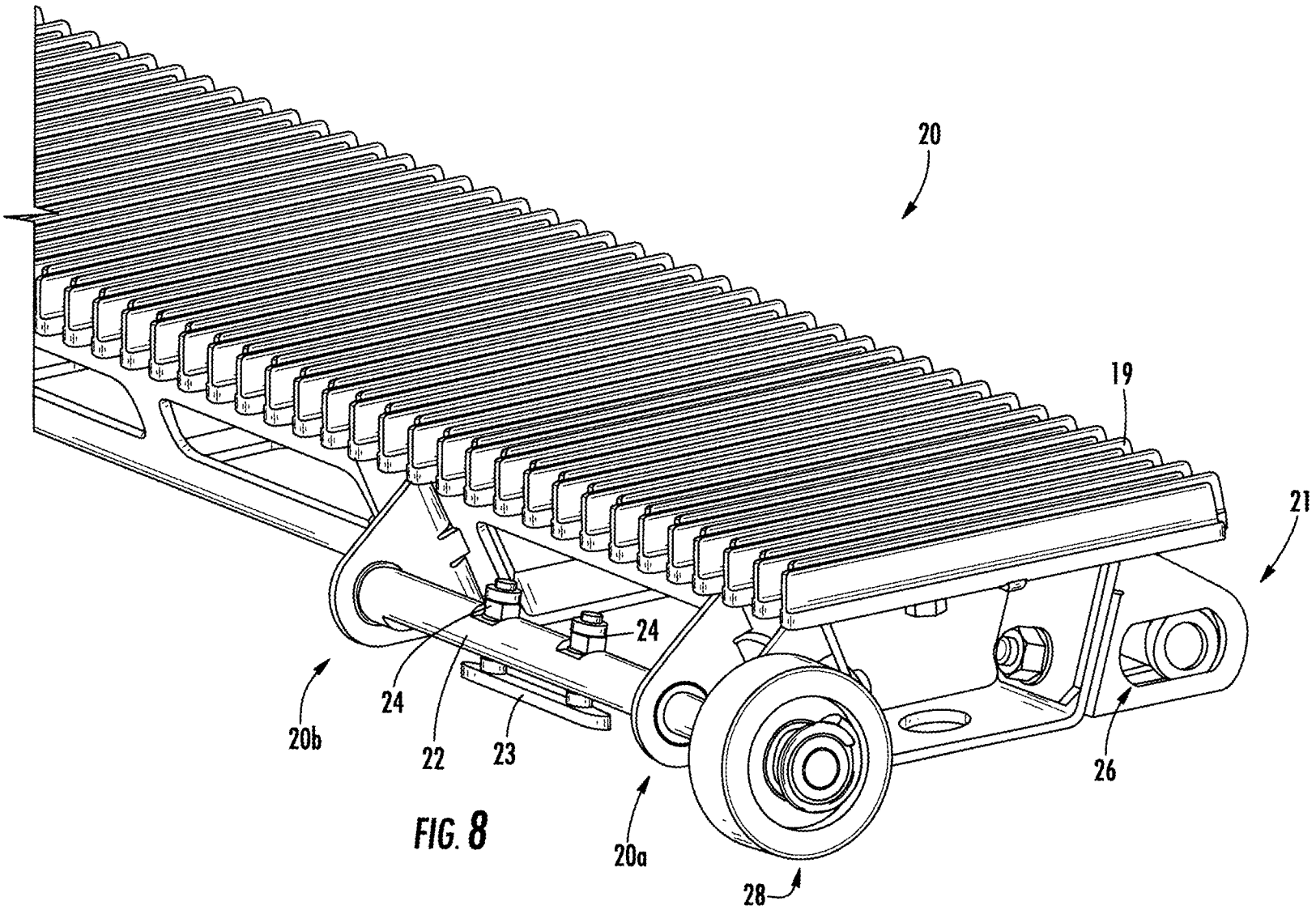
FIG. 8 shows a perspective view of a pallet according to another exemplary embodiment of the invention.

FIG. 8 shows a perspective view of a pallet 20 according to another exemplary embodiment of the invention.

In the embodiment depicted in FIG. 8, the outer and inner linkage axles 22*a*, 22*b* may be formed integrally with each other forming a single linkage axle 22 extending between the outer and inner mounting portions 20*a*, 20*b* of the pallet 20. The linkage axle 22 is fixed to the belt 12 (not show in FIG. 8) using a web 23. The web 23 is fixed to the linkage axle 22 by screws 24. When the pallet 20 is attached to the belt 12, the belt 12 extends between the linkage axle 22 and the web 23, and the screws 24 extend through the belt 12.

In the embodiment shown in FIGS. 2 to 8, the belts 12, the linkage axles 22, 22*a*, 22*b* and the pallet rollers 28 are arranged under the pallets 20 in the conveyance portion 16 and above the pallets 20 in the return portion 18. Hence, no parts of the conveyance band 10 extend beyond the pallets 20 in the lateral direction. As a result, the dimension of the conveyance band 10 in the lateral direction is defined by the width of the pallets 20, which may be up to e.g. 1400 mm.

The depicted configuration allows reducing the total width of the conveyance band 10 compared to a configuration in which the belts 12, the linkage axles 22, 22*a*, 22*b* and/or the pallet rollers 28 are arranged laterally to the pallets 20.

In the embodiments shown in the figures, the pallet rollers 28 are arranged outside the two belts 20 in the lateral direction.

In an alternative embodiment, which is not shown in the figures, the pallet rollers 28 may arranged between the two belts 12 in the lateral direction.

Although the exemplary embodiments illustrated in the figures comprise two belts 12 extending parallel to each other, the skilled person will understand that the principles of the invention may be applied equally to moving walkways 1 comprising only one belt 12 or more than two belts 12.

Similarly, more than two pallet rollers 28 may be attached to each of the pallets 20 in order to reduce the load acting on each of the pallet rollers 28. Additional pallet rollers 28 in particular may be supported by the inner linkage axles 22*b* or an inner end portion of the linkage axles 22.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention include all embodiments falling within the scope of the claims.

REFERENCES

1 moving walkway
4 balustrade
5 first turnaround portion
6 handrail
7 second turnaround portion
10 conveyance band
12 belt
14*a*, 14*b* sprockets
16 conveyance portion
18 return portion
19 tread plate
20 pallet
20*a* outer mounting portion
20*b* inner mounting portion
21 connection/connection portion
22 linkage axle
22*a* outer linkage axle
22*b* inner linkage axle
23 web
24 screw
26 elongate hole
28 pallet roller
30, 32 guide rails
D diameter of the turnaround portions
d diameter of the pallet rollers

What is claimed is:

1. Moving walkway comprising:

at least one endless belt moving in a conveyance direction along a closed loop, the closed loop comprising a conveyance portion and a return portion extending between two turnaround portions, respectively; and a plurality of pallets, each of the pallets comprising:

at least one mounting portion rotatably attached to the at least one endless belt; and at least one mechanical connection connecting the pallet with the at least one mounting portion of an adjacent pallet;

a web attached to the at least one endless belt;

wherein the at least one mounting portion is rotatably attached to the at least one endless belt at the web.

2. Moving walkway according to claim 1, wherein the least one mechanical connection is provided by at least one connection portion.

3. Moving walkway according to claim 2, wherein the connection portion is formed integrally with the pallet.

4. Moving walkway according to claim 1, wherein the at least one mechanical connection has an elongated hole.

5. Moving walkway according to claim 4, wherein the elongated hole extends parallel to the at least one endless belt.

6. Moving walkway according to claim 5, wherein the at least one mounting portion comprises at least one linkage axle or pin rotatably mounted to the at least one endless belt and extending through the elongated hole so that the at least one linkage axle or pin is rotatable and/or slidable within the elongated hole.

7. Moving walkway according to claim 6, wherein the at least one linkage axle or pin is rotatably supported by the web.

8. Moving walkway according to claim 7, wherein the web is attached to the at least one endless belt at a position corresponding to a portion of the at least one endless belt which is neither compressed nor stretched when the endless belt is bent.

9. Moving walkway according to claim 1, wherein the at least one endless belt is arranged below the pallets when the pallets are located in the conveyance portion.

10. Moving walkway according to claim 1, further comprising:

pallet rollers attached to the pallets and guide rails configured for guiding and supporting the pallet rollers.

11. Moving walkway according to claim 10, wherein the pallet rollers are configured to travel along the turnaround portions without being supported by any guide rails.

12. Moving walkway according to claim 10, wherein each of the pallets is equipped with at least two pallet rollers.

13. Moving walkway according to claim 12, wherein the least two pallet rollers are arranged coaxially with each other.

14. Moving walkway according to claim 12, wherein the at least one endless belt is arranged between the at least two pallet rollers.

15. Moving walkway according to claim 1 wherein the at least one endless belt comprises at least two endless belts extending parallel to each other, wherein each pallet is attached to each of the at least two endless belts.

16. Moving walkway according to claim 15, wherein the pallet rollers are arranged between the at least two belts.

* * * * *